US006401610B1

(12) United States Patent
Becker et al.

(10) Patent No.: US 6,401,610 B1
(45) Date of Patent: Jun. 11, 2002

(54) METHOD FOR TAKING OVER A SHEET BY A TRAILING EDGE THEREOF FROM AN UPLINE CYLINDER OF A SHEET-FED ROTARY PRINTING PRESS, AND A TRANSMISSION SYSTEM FOR PERFORMING THE METHOD

(75) Inventors: Willi Becker, Bammental; Andreas Fricke, Eberbach, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/363,274

(22) Filed: Jul. 28, 1999

(30) Foreign Application Priority Data

Jul. 28, 1998 (DE) ..... 198 33 903

(51) Int. Cl.[7] ..... B41F 13/24
(52) U.S. Cl. ..... 101/232; 101/409; 271/277
(58) Field of Search ..... 101/230–232, 101/246, 407.1, 408, 409, 411; 271/3.21, 225, 184–189

(56) References Cited

U.S. PATENT DOCUMENTS

| | | | | | |
|---|---|---|---|---|---|
| 3,992,993 | A | * | 11/1976 | Kuhn et al. | 101/409 |
| 4,132,403 | A | * | 1/1979 | Weisbach et al. | 271/277 |
| 4,210,079 | A | * | 7/1980 | Raes | 101/242 |
| 4,290,595 | A | * | 9/1981 | Thunker | 271/277 |
| 4,295,422 | A | * | 10/1981 | Thunker | 101/232 |
| 4,358,100 | A | * | 11/1982 | Muller | 271/11 |
| 4,370,928 | A | * | 2/1983 | Weisbach et al. | 101/242 |
| 4,909,150 | A | * | 3/1990 | Leyendecker et al. | 101/232 |
| 5,142,983 | A | * | 9/1992 | Kobler et al. | 101/409 |
| 5,398,607 | A | * | 3/1995 | Ricke et al. | 101/409 |
| 5,440,983 | A | * | 8/1995 | Dopke et al. | 101/410 |

FOREIGN PATENT DOCUMENTS

| | | |
|---|---|---|
| DE | 110 452 | 12/1974 |
| DE | 40 12 497 C2 | 10/1991 |
| DE | 40 12 498 C1 | 11/1991 |
| DE | 196 17 544 C1 | 4/1997 |
| DE | 196 17 545 C1 | 4/1997 |
| DE | 196 17 493 A1 | 11/1997 |
| DE | 196 17 542 A1 | 11/1997 |
| DE | 196 17 543 C2 | 11/1997 |

* cited by examiner

*Primary Examiner*—Eugene Eickholt
(74) *Attorney, Agent, or Firm*—Laurence A. Greenberg; Werner H. Stemer; Gregory L. Mayback

(57) ABSTRACT

A method for taking over a sheet by a trailing edge thereof from an upline cylinder of a sheet-fed rotary printing press and transferring the sheet by the trailing edge thereof to a gripper system, by placing a suction gripper on the sheet in a marginal region of the trailing edge and, during the sheet takeover, having the suction gripper follow the periphery of the upline cylinder, having the suction gripper guided at a constant tangent into the periphery of a downline inverting drum and, along this course, having the suction gripper execute a relative motion in the direction of the tangent so as to tauten the sheet, which comprises, upon reaching a transfer position at the gripper system, having the suction gripper execute a relative motion in the sheet transport direction and, when the grippers close, having the suction gripper and the gripper system disposed at rest relative to one another; and a transmission system for performing the method.

5 Claims, 4 Drawing Sheets

METHOD FOR TAKING OVER A SHEET BY A TRAILING EDGE THEREOF FROM AN UPLINE CYLINDER OF A SHEET-FED ROTARY PRINTING PRESS, AND A TRANSMISSION SYSTEM FOR PERFORMING THE METHOD

BACKGROUND OF THE INVENTION

Field of the Invention

Method for taking over or receiving a sheet by a trailing edge thereof from an upline cylinder of a sheet-fed rotary printing press and transferring the sheet by the trailing edge thereof to a gripper system of a downline drum, and a transmission system for performing the method.

For inverting sheets in a rotary printing press, it has become known heretofore for a sheet transported on an upline cylinder to be grasped by the trailing edge thereof by a lifting device, such as a suction gripper, and transferred to a gripper device of a downline drum, such as an inverting drum. The trailing edge of the sheet in the region of the gripper device, within the periphery of the downline drum, by reasons of geometry, describes a shorter course than the leading edge of the sheet that is still on the upline cylinder. This leads to an unintended tautening of the sheet during the transfer; that is, the leading edge of the sheet is grasped by the gripper device of the upline cylinder at the same time as the trailing edge of the sheet is grasped by the gripper device of the downline drum.

Another problem arises when, as the sheet is taken from the upline cylinder, the holding surfaces of the suction grippers which are provided do not rest constantly on a tangent to the upline cylinder jacket surface. The latter would then execute a tilting motion relative to the sheet to be transported, which can lead to the loss of the sheet.

A great number of attempts to overcome this problem have already been disclosed in the prior art. For example, from the published German Patent Documents DE 40 12 497 C2 and DE 40 12 498 C1, It has become known to use sucker transmissions, which guide a sucker carrier with the aid of two cam-controlled rollers and enable accurate tracking of a trailing-edge sucker relative to an impression-cylinder jacket surface as the sheet is being removed. Sheet straightening or tautening and buckling are furthermore possible, but only over the direct course to the inverting gripper of the downline drum. The cam segments for controlling the sucker transmission are secured to the inverting drum. The use of multiple-size inverting drums with a plurality of transport systems leads to a large number of cam segments which, on the one hand, for production reasons, are vulnerable to error, and cannot be adjusted to one another without error even if the individual cam segments are adjusted in a complex and costly manner. As a consequence, the trailing edge of the sheet has different transport paths, which leads to rhythmical transfer errors of the sheets, with resultant undesired doubling phenomena.

The published German Patent Document DE 196 17 545 C1 shows a sucker transmission through the intermediary of a crank, namely a combination of a rocker and a coupling link, which is unable to execute the takeover of sheets from the printing cylinder at a constant tangent. This means that the portion of the sheet that is free of the suction surface or has already been taken over is not located at all times on a tangent to the printing cylinder jacket face. Especially with heavy paper, such as cardboard, this provision can lead to the loss of the sheet.

The published German Patent Document DE 196 17 493 A1 shows a sucker guide through the intermediary of revolving wheel transmissions, but this is still unable to maintain the desired constancy of the tangent.

The published German Patent Documents DD-WP 110 452, DE 196 17 542 A1, DE 196 17 543 A1 and DE 196 17 544 C1 show four and five-linkage transmissions for guiding the suction devices. However, these transmissions are incapable of executing a constant-tangent sheet removal from the upline cylinder, nor is a purposeful tautening or bulging of the sheet after sheet removal possible, especially with the four-link mechanisms.

SUMMARY OF THE INVENTION

It is accordingly an object of the invention to provide a method by which a sheet can be taken over by its trailing edge from an upline cylinder for the purpose of inverting and transferring the sheet without jolting to a downline cylinder, in which the trailing edge of the sheet, until a firm gripper lock takes place, is to be guided at a constant tangent to a forward sheet region contacting the upline cylinder, and to provide a transmission system for performing the method.

With the foregoing and other objects in view, there is provided, in accordance with one aspect of the invention, a method for taking over a sheet by a trailing edge thereof from an upline cylinder of a sheet-fed rotary printing press and transferring the sheet by the trailing edge thereof to a gripper system, by placing a suction gripper on the sheet in a marginal region of the trailing edge and, during the sheet takeover, having the suction gripper follow the periphery of the upline cylinder, having the suction gripper guided at a constant tangent into the periphery of a downline inverting drum and, along this course, having the suction gripper execute a relative motion in the direction of the tangent so as to tauten the sheet, which comprises, upon reaching a transfer position at the gripper system, having the suction gripper execute a relative motion in the sheet transport direction and, when the grippers close, having the suction gripper and the gripper system disposed at rest relative to one another.

In accordance with another aspect of the invention, there is provided a transmission system on an inverting drum of a sheet-fed rotary printing press for guiding a retaining element for a trailing edge of a sheet, comprising three mutually coupled drive systems controllable independently of one another for generating a path of motion of the retaining element.

In accordance with a further feature of the invention, each of the drive systems includes a roller lever embodied as a rocker swivellably supported on the inverting drum.

In accordance with an added feature of the invention, the rockers have respective control rollers operatively engageable with stationary control cams.

In accordance with an additional feature of the invention, the transmission system includes a sucker carrier guidable by a crank and a coupling link.

In accordance with yet another feature of the invention, the coupling link has three articulating joints, and each of the articulating joints is connected to one of the drive systems.

In accordance with yet a further feature of the invention, the coupling link is guided by a crank and the rocker, and is connected at one of the articulating joints to the sucker carrier.

In accordance with yet an added feature of the invention, the rocker has a toothed quadrant meshing with a toothed quadrant of the coupling link, and two of the rockers have a common bearing point.

In accordance with yet an additional feature of the invention, the system is disposed multiply along the axial length of the inverting drum.

In accordance with an alternate feature of the invention, a cylinder is disposed upline of the inverting drum, and the system is disposed multiply along the axial length of the cylinder.

In accordance with a concomitant mode of the method of the invention, the gripper system is formed of inverting grippers on the downline inverting drum and, when a transfer position is reached at the inverting grippers, the suction gripper is caused to execute the relative motion in the sheet transport direction, and the suction gripper and the inverting grippers are disposed at rest relative to one another when the grippers close.

It is an advantage of the invention that the sheet is transferrable at a constant tangent to the gripper device of the inverting drum.

By the transmission according to the invention, the trailing edge of the sheet can be guided along the gripper pad of the inverting drum gripper at a relative speed, so that the sheet is caused to bulge in an intended manner. The resultant bellying of the sheet counteracts a geometrically dictated tautening of the sheet. Consequently, the transfer of the trailing edge of the sheet to the inverting gripper takes place without tension or jolting.

Adjustment is made considerably shorter and easier by disposing the cam segments for controlling the sucker transmission in a stationary manner. Particularly when inverting drums multiply larger are used, with a plurality of sucker systems distributed over the circumference, each sucker system is controlled by a common cam. This provision minimizes rhythmical transfer errors.

Doubling caused by transfer errors upon inversion is advantageously prevented. The quality of the printing is improved. Two exemplary embodiments are shown in the drawings and are described hereinbelow.

Other features which are considered as characteristic for the invention are set forth in the appended claims.

Although the invention is illustrated and described herein as embodied in a method for taking over a sheet by a trailing edge thereof from an upline cylinder of a sheet-fed rotary printing press, and a transmission system for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
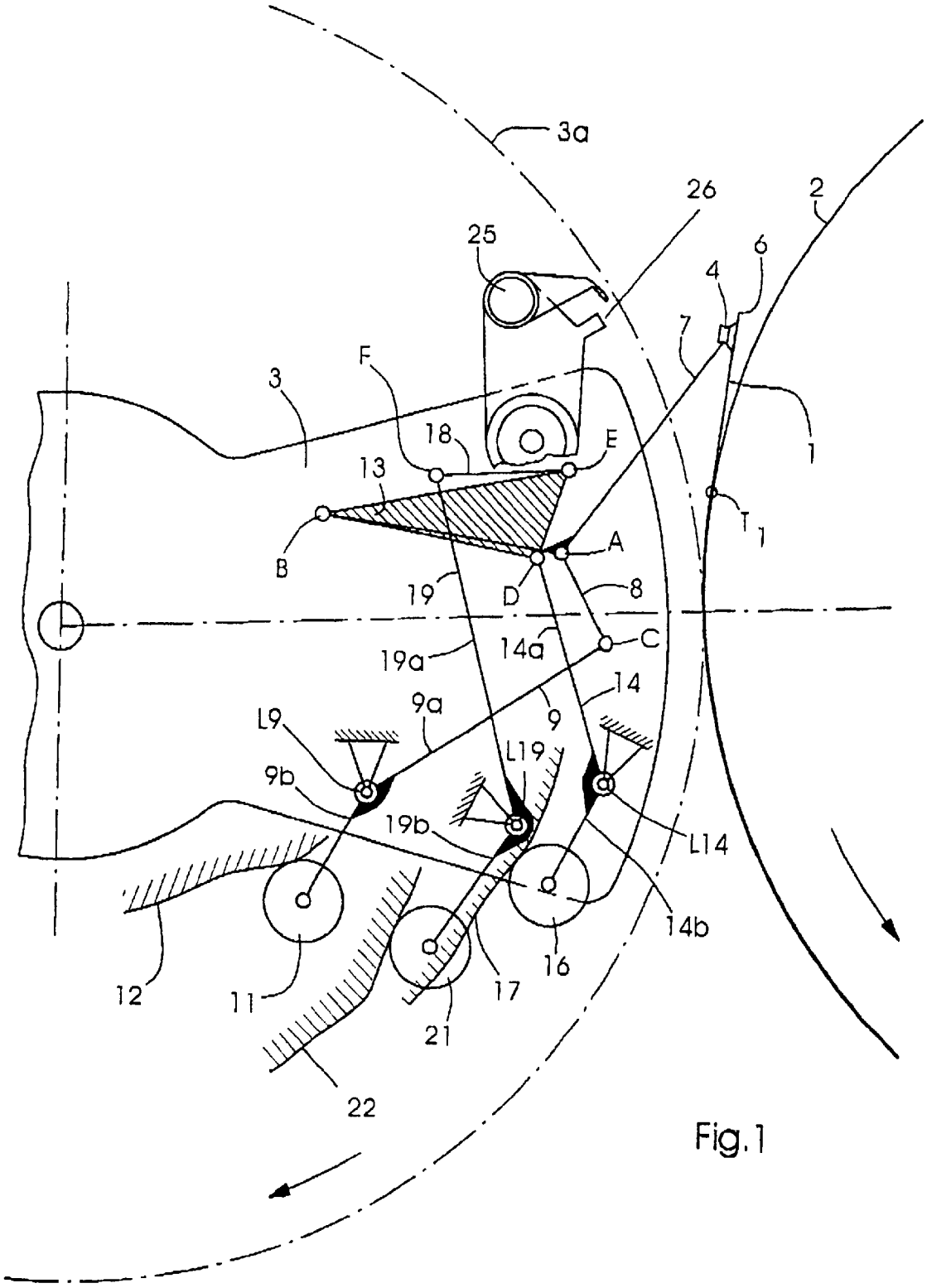
FIG. 1 is a diagrammatic view of a first exemplary embodiment of a sucker transmission according to the invention upon removal of the trailing edge of the sheet from an upline cylinder.
Figure 2:
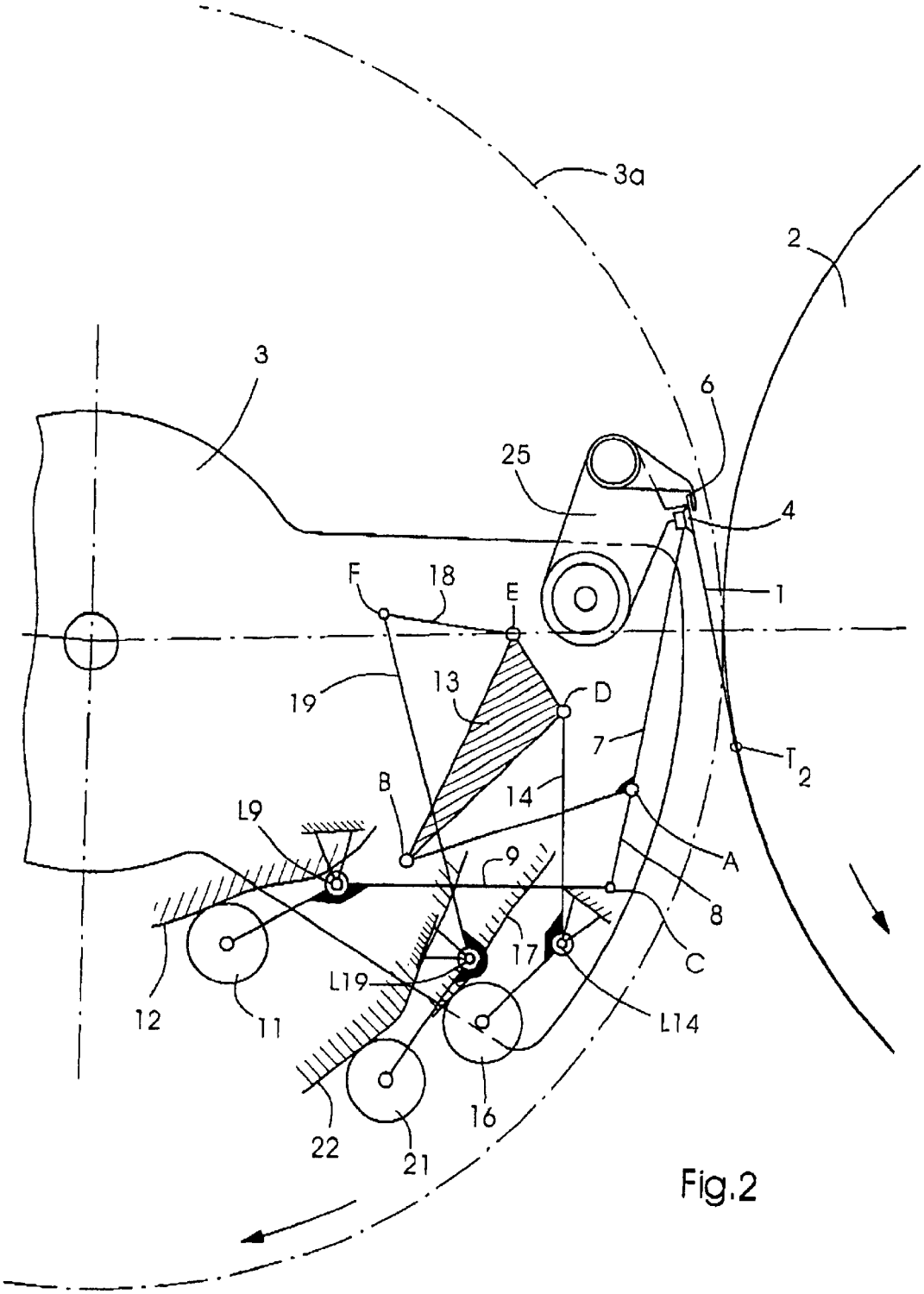
FIG. 2 is another view of FIG. 1 showing the sucker transmission during the transfer of the sheet by the trailing edge thereof from the suction device to the inverting gripper of the inverting drum.

Referring now to the drawings and, first, particularly to FIGS. 1 and 2 thereof, there is shown therein a sheet-fed rotary printing press having, among other elements, a cylinder 2 such as a printing cylinder, transporting the sheet 1, the cylinder 2 being directly upline from a further cylinder or drum 3, such as an inverting drum, that also transports the sheet 1. A lifting device 4, such as a suction gripper, for grasping the trailing edge 6 of the sheet, is disposed swivellably on the inverting drum 3. For transferring the sheet 1, the suction gripper swivels out of the periphery of the inverting drum 3 and seats itself on the sheet 1 in a marginal region of the trailing edge 6. The suction gripper 4 is secured to the end of a sucker carrier 7. The sucker carrier 7 has an angled coupling link with a first, movable articulating joint A in the region of the angle and a second, movable articulating joint B at the end of the coupling link, or of the sucker carrier 7. A crank, including a coupling link 8 and a rocker 9 connected thereto at an articulating joint C, is articulatedly connected to the sucker carrier 7 at articulating joint A. The rocker 9 has two arms 9*a* and 9*b* and is pivotably supported at a bearing point L9 on the inverting drum 3 at the connecting point of the two arms 9*a* and 9*b*. On one end of the arm 9*b*, a cam roller 11 is disposed, and operatively engages a stationary control cam 12. A coupling link 13 with two further articulating joints D and E is articulatedly connected to the sucker carrier 7 at the articulating joint B.

At the articulating joint D of the coupling link 13, a second rocker 14 is mounted; it has two arms 14*a* and 14*b*. At the connecting point of the two arms 14*a* and 14*b*, a swivellable bearing point L14 is provided on the inverting drum 3. A cam roller 16 which is in operative engagement with a stationary control cam 17 is disposed on the end of the arm 14*b*.

A crank, formed of a coupling link 18 and a rocker 19 mounted at an articulating joint F, is disposed at the articulating joint E of the coupling Link 13. The rocker 19 has two arms 19*a* and 19*b* and is swivellably supported at a bearing point L19 of the inverting drum 3 at the connecting point of the two arms 19*a* and 19*b*. On its arm 19*b*, the rocker 19 has a cam roller 21, which is in operative engagement with a stationary control cam 22.

The rockers 9, 14 and 19 are swivelled about the bearing points L9, L14 and L19, respectively, by the rotary motion of the inverting drum 3 and by the contours of the control cams 12, 17 and 22, respectively. In this regard, the sucker carrier 7 is swivelled therewith as well, via the coupling links 8 and 13, in such a manner that the suction gripper 4, after approaching the printing cylinder 2, initially follows the periphery of the printing cylinder 2 until the trailing edge 6 of the sheet is securely grasped by the suction gripper 4. Then, the suction gripper 4 is swivelled along a constant-tangent guide path into the periphery 3*a* of the inverting drum 3. By "constant-tangent" there is meant that an imaginary lengthening of the holding surface of the suction gripper 4, and thus also of the free trailing region of the sheet, is always oriented at a tangent to the upline printing cylinder 2; a tangent point $T_1$ migrates counterclockwise over the circumference of the printing cylinder 2 with the transfer path of the trailing edge 6 of the sheet.

The suction device 4 secured to the sucker carrier 7 is made to approach the printing cylinder 2 and, at the onset of sheet suction, it has the same speed and acceleration conditions as those of the trailing edge 6 of the sheet that it follows exactly during the entire suction process.

Thereafter, the removal of the sheet begins; the suction surface along with the free region of the sheet is always located on a tangent to the impression-cylinder jacket surface. During the removal, tautening of the sheet can be performed, the suction device 4 being guided along the tangent in the direction of the trailing edge 6 of the sheet, and sliding along the sheet.

For transferring the trailing edge to the inverting gripper 25, the suction device 4 is brought without impact or jolting to the condition of motion of a gripper pad 26 of the inverting gripper 25. The suction device 4 and the trailing edge 6 of the sheet are finally in relative repose with respect to the inverting drum 3 or the inverting gripper 25. The smaller the spacing between the trailing edge 6 of the sheet and the rotational point of the inverting drum, the more strongly is the sheet, which is held at the leading edge thereof by the impression-cylinder grippers and at the trailing edge thereof by the suction grippers 4, exposed to a geometrically dictated stretching.

The instant the holding surface of the suction gripper 4 and the gripper pad 26 of the inverting gripper 25 are disposed in the same plane, or in other words, an imaginary lengthening of the gripper pad 26 and the holding surface is a common tangent to the printing cylinder 2 at the tangent point $T_2$, the suction gripper 4 is accelerated slightly relative to the sheet 1 in the sheet travel direction, leading to a bellying or bulging of the sheet. Due to the provision that the trailing edge 6 of the sheet is transferred to the inverting gripper 25 inside the periphery of the inverting drum 3, the trailing edge 6 of the sheet, for reasons of geometry, traverses a shorter distance than the leading edge of the sheet. This is compensated for by the sheet bellying or bulging that has been brought about beforehand, and thus the transfer of the trailing edge 6 of the sheet to the inverting gripper 25 takes place without tension and thus without strain.

Figure 3:
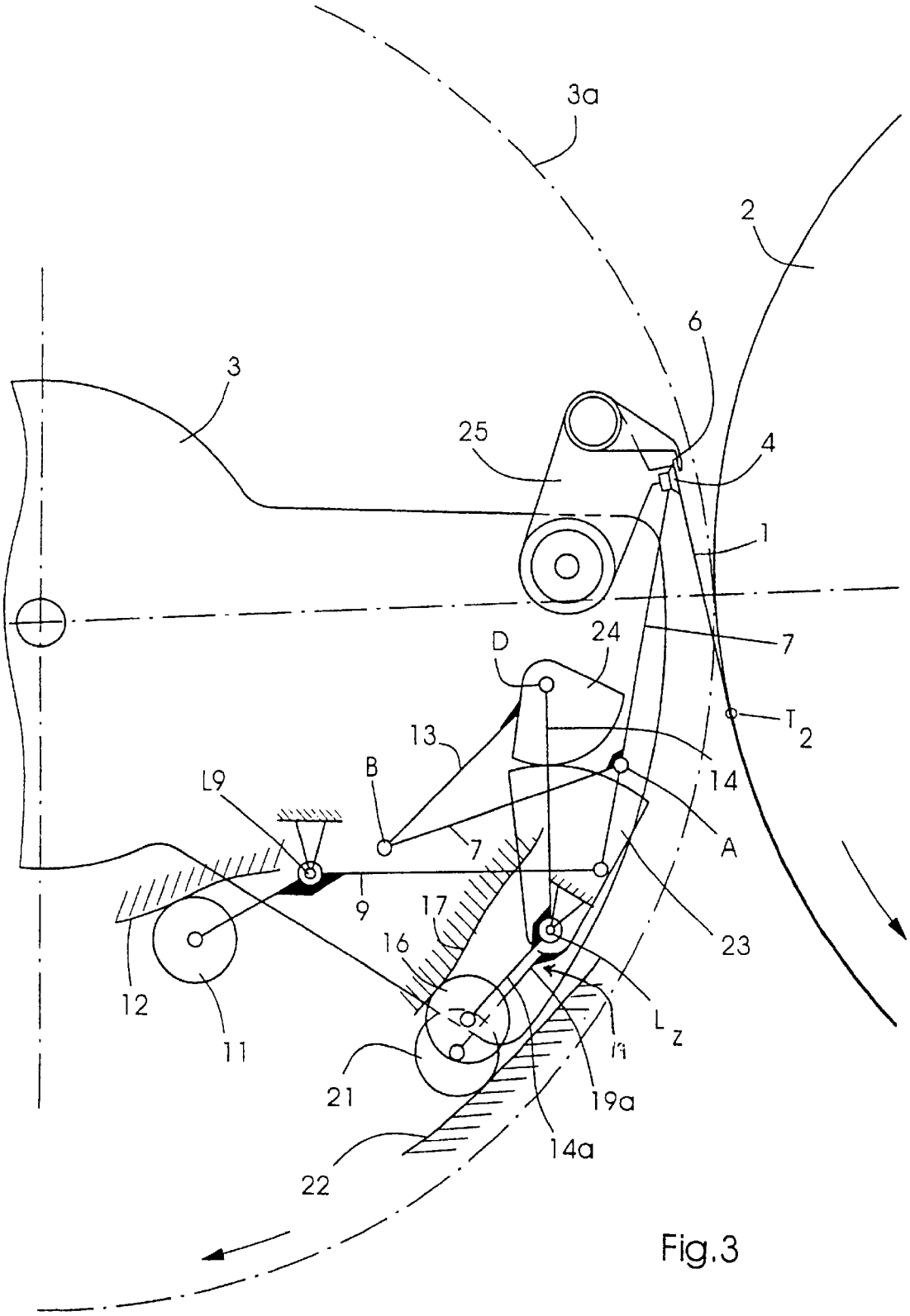
FIG. 3 is a view line that of FIG. 2 of a second exemplary embodiment of the invention.

In a second exemplary embodiment of FIG. 3, the arm 19*a* of the rocker 19 is provided with a toothed quadrant 23, which meshes with a toothed quadrant 24 disposed on the end of the coupling link 13. The swivel joint D of the rocker 14 is located, in this regard, at the center of the toothed quadrant 24. The rockers 14 and 19 have a common bearing point $L_z$ which, in turn, is identical with the center of the toothed quadrant 23. The coupling link 18 of the first exemplary embodiment is not needed.

Figure 4:
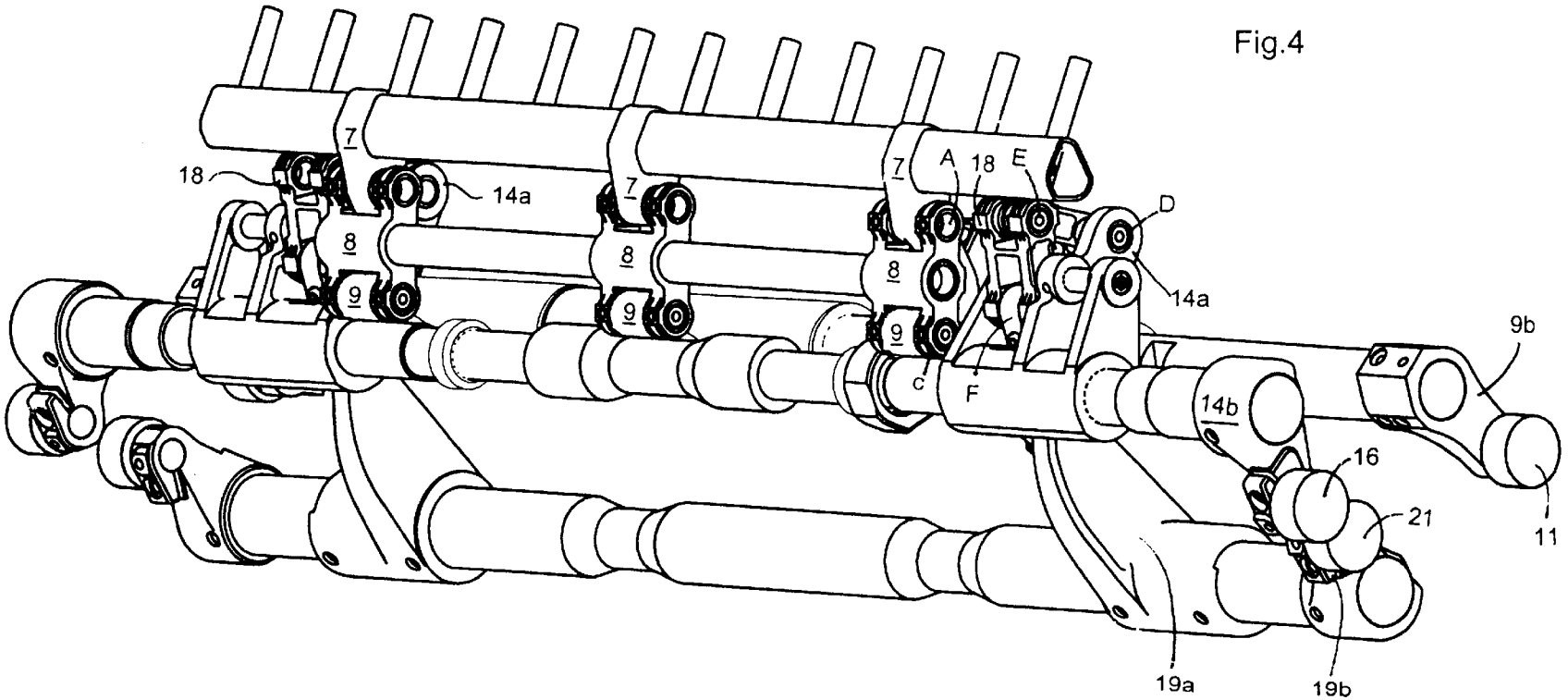
FIG. 4 is a perspective view of a cylinder.

In the interest of simplicity, the transmission system according to the invention has been describe in terms of a single sectional plane through the inverting drum. FIG. 4 shows multiple transmissions can also be disposed over the axial length of the cylinder or the drum.

We claim:

1. A transmission system on an inverting drum of a sheet-fed rotary printing press for guiding a retaining element for a trailing edge of a sheet, comprising:

three mutually coupled drive systems controllable independently of one another for generating a path of motion of the retaining element on the inverting drum of the sheet-fed rotary printing press, the retaining element releasably holding the trailing edge of the sheet; each of said drive systems including a roller lever embodied as a rocker swivellably supported on the inverting drum; said rockers having respective control rollers operatively engageable with stationary control cams;

a coupling link having three articulating joints, each of said articulating joints connecting to one of said drive systems;

a crank connected to one of said three articulating joints of said coupling link; and a sucker carrier guidable by said crank and said coupling link.

2. The transmission system according to claim 1, wherein said coupling link is guided by said crank and said rockers of said drive systems, and is connected at one of said articulating joints to said sucker carrier.

3. The transmission system according to claim 1, wherein the inverting drum has an axial length and said three mutually coupled drive systems are disposed along the axial length of the inverting drum.

4. The transmission system according to claim 1, wherein a cylinder having an axial length is disposed upline of the inverting drum, and said three mutually coupled drive systems are disposed along the axial length of the cylinder.

5. A transmission system on an inverting drum of a sheet-fed rotary printing press for guiding a retaining element for a trailing edge of a sheet, comprising:

three mutually coupled drive systems controllable independently of one another for generating a path of motion of the retaining element on the inverting drum of the sheet-fed rotary printing press, the retaining element releasably holding the trailing edge of the sheet; each of said drive systems including a roller lever embodied as a rocker swivellably supported on the inverting drum; two of said rockers having respective control rollers operatively engageable with stationary control cams; one of said rockers having a toothed quadrant, and two of the rockers having a common bearing point;

a coupling link having three articulating joints, one of said articulating joints connecting a toothed quadrant meshing with said toothed quadrant of said one of said rockers;

a crank connected to one of said three articulating joints of said coupling link; and a sucker carrier guidable by said crank and said coupling link.

* * * * *